United States Patent [19]

Bernecker

[11] Patent Number: 4,575,949

[45] Date of Patent: Mar. 18, 1986

[54] PRESS FOR PRESSING BATCHES OF ARTICLES DRY

[75] Inventor: Gerhard Bernecker, Heilbronn, Fed. Rep. of Germany

[73] Assignee: Passat Maschinenbau GmbH, Heilbronn/Frankenbach, Fed. Rep. of Germany

[21] Appl. No.: 671,225

[22] Filed: Nov. 14, 1984

[30] Foreign Application Priority Data

Nov. 18, 1983 [DE] Fed. Rep. of Germany ..... 3341683

[51] Int. Cl.[4] ..... D06F 47/06

[52] U.S. Cl. ..... 34/14; 100/211; 100/143; 68/21; 68/242

[58] Field of Search ..... 100/211, 127, 37, 116; 68/242, 210, 21, 96, 241; 34/143, 146, 14

[56] References Cited

U.S. PATENT DOCUMENTS 3,460,363 8/1969 Grantham .
3,908,413 9/1975 Meyer ..... 68/242
3,924,425 12/1975 Arendt .
4,180,995 1/1980 Meyer ..... 100/211
4,452,056 6/1984 Files .

*Primary Examiner*—Larry I. Schwartz
*Attorney, Agent, or Firm*—Collard, Roe & Galgano

[57] ABSTRACT

The press for pressing batches of articles dry, especially batches of laundry, has a pressure vessel (10) at the pressing station, the orifice of which can be closed by a counterplate (18), and a receiving vessel (4) for receiving the batch of articles at the filling station and for transporting it on a plate (2) into the pressing station under the pressure vessel. The object of the invention is to improve a press of this type, in such a way that the batch of articles is introduced into the pressure vessel in a reliable and faultless way. For this purpose, the pressure vessel is mounted at the pressing station so as to be stationary and at a distance above the plate, the receiving vessel has a height corresponding to the distance between the pressure vessel and the plate, the counterplate can be moved into the pressure vessel by means of the receiving vessel, and, when the counterplate is raised, the receiving vessel can be drawn back into the filling station from the pressing station.

7 Claims, 4 Drawing Figures

FIG.3
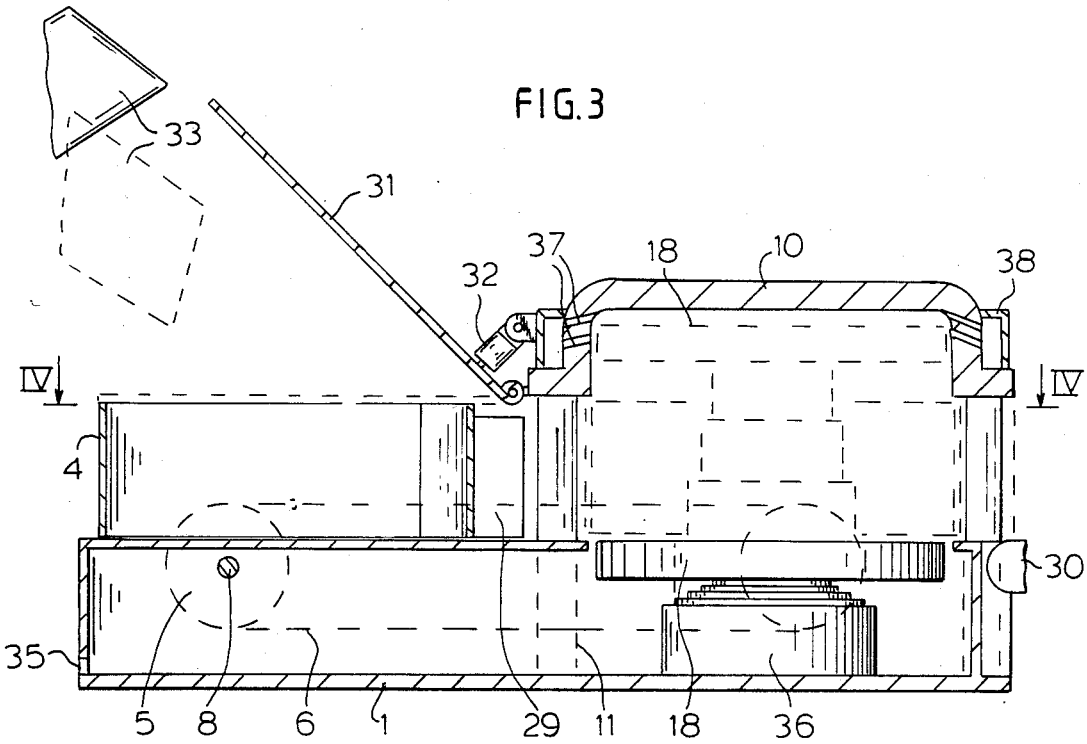
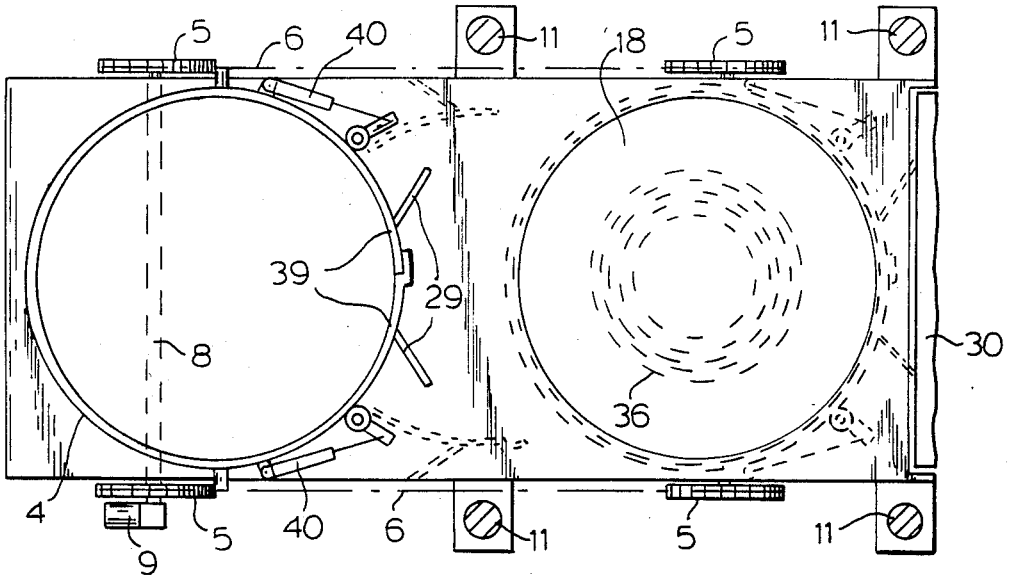
FIG.4

PRESS FOR PRESSING BATCHES OF ARTICLES DRY

The invention relates to a press for pressing batches of articles dry, especially batches of laundry, with a pressure vessel at the pressing station, the orifice of which can be closed by a counterplate, and with a receiving vessel for receiving the batch of articles at the filling station and for transporting it on a plate into the pressing station under the pressure vessel.

A press of the type mentioned in the introduction is already known from German Offenlegungsschrift No. 2,311,013, and in this, at the filling station, the batch of articles in the form of a batch of laundry falls from a washing machine into a frame open at the top. This is then moved under the raised pressure vessel at the pressing station, from which, after the front wall has been opened, it is drawn back into the filling station again. The pressure vessel is lowered onto the batch of articles left behind. When pressurized water is introduced, a diaphragm present in the pressure vessel is then pushed against the batch of articles and presses it dry. A disadvantage of this is that, after the frame has been drawn back, the relatively loose batch of articles is left lying without being supported laterally and can easily fall apart. Consequently, parts of the batch of articles can escape from the press surface, so that the pressing operation has to be interrupted and the batch of articles rearranged by hand. This means an interruption in the otherwise automatic operation, as a result of which the entire treatment process of the handling line is sometimes disturbed.

The object of the invention is, therefore, to improve the press of the type mentioned in the introduction, in such a way that the batch of articles is introduced into the pressure vessel reliably and faultlessly.

As a result of the invention, this object is achieved because the pressure vessel is mounted at the pressing station so as to be stationary and at a distance above the plate, the receiving vessel has a height corresponding to the distance between the pressure vessel and the plate, the counterplate can be moved into the pressure vessel by means of the receiving vessel, and, when the counterplate is raised, the receiving vessel can be drawn back into the filling station from the pressing station.

The advantages which can be achieved by means of the invention are, in particular, that the batch of articles, after being introduced into the receiving vessel, is transported into the pressure vessel whilst at the same time being encased all-round. It is therefore impossible for any part of the batch of articles, after being introduced into the receiving vessel, to become separated and assume a position in which the pressing operation is disturbed. In this way, the transition from the pretreatment machine, for example the washing machine, to the aftertreatment machine, for example a mangle or a dryer, takes place positively. There is no possibility of a fault caused by parts of articles falling out. The press according to the invention therefore increases operating reliability and guarantees faultless press operation.

Exemplary embodiments of the invention are illustrated in the drawing and described in more detail below. In the drawing:

FIG. 3 shows a longitudinal section through another embodiment of the press; and FIG. 4 shows a sectional view along the line IV—IV in FIG. 3.

Figure 1:
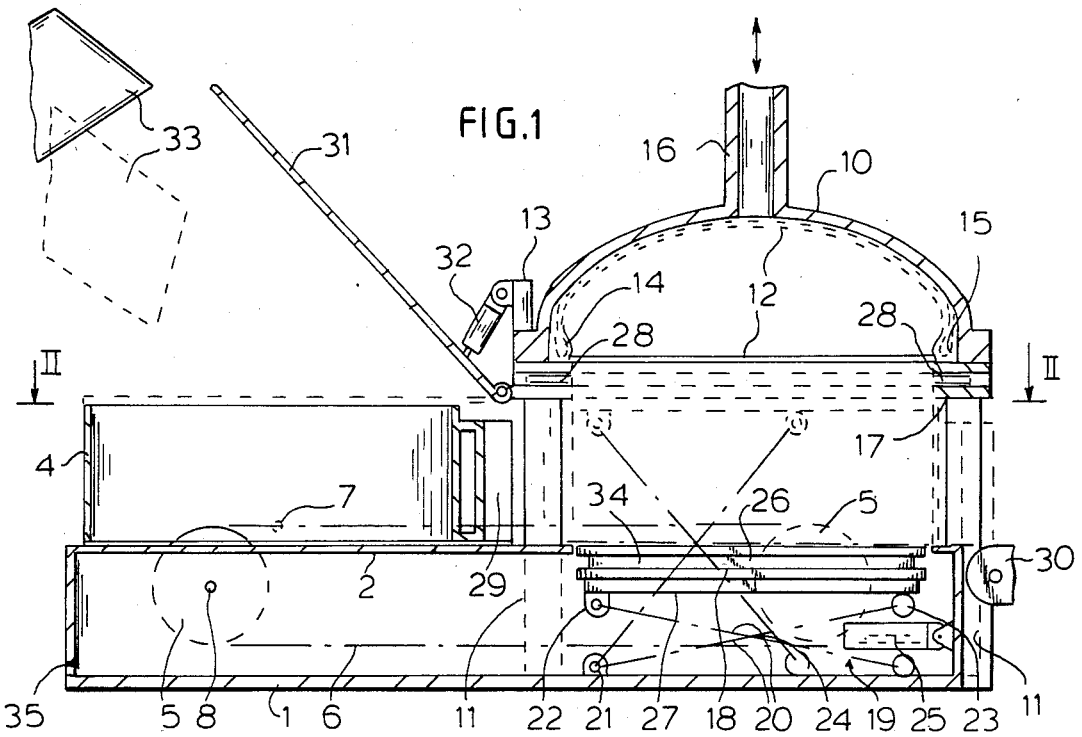
FIG. 1 shows a longitudinal section through the press.

Now turning to the drawings, there is shown in FIG. 1 a press for pressing batches of articles dry, especially batches of laundry, but also skins and the like, having a base frame 1 which is covered at the top by a perforated or non-perforated plate 2. A cylindrical receiving vessel 4 is mounted displaceably on the plate 2, so that it can be moved out of the filling position, represented by unbroken lines in FIGS. 1 and 2, at the filling station to the right into the position, indicated by dot-and-dash lines, at the pressing station and back again. For this purpose, a drawing means 6, such as, for example, a chain, which is laid over wheels 5 at the two ends and which is connected to the receiving vessel 4 by means of bolts 7, is provided as means of transport on each of the two sides. The wheels 5 at the filling station are connected fixedly to one another in terms of location by means of a shaft 8. A reversible geared motor 9 is connected to an extension of the shaft 8, in order to set the drawing means 6 and consequently the receiving vessel 4 in motion in one direction or the other.

At the pressing station, above the plate 2, a bell-shaped pressure vessel 10 is arranged, with its orifice pointing downwards, on columns 11 mounted laterally next to the base frame 1. An elastic diaphragm 12 is inserted in the pressure vessel 10 at the height of the orifice. This diaphragm rests sealingly by means of a sealing edge 13 against the inner surface of the pressure vessel 10. The diaphragm 12 is stiffened by a ring 14 which is embedded in the vicinity of the sealing edge 13 and which comes up against stops 15, to prevent penetration into the interior of the pressure vessel 10. At the top, the pressure vessel 10 has a pipe 16 for introducing and discharging a pressure medium, such as, for example, pressurized water, and this pipe is connected to a pressure pump or the like (not shown) and to an appropriately controllable line system. It is evident that when the pressure medium is pumped out the diaphragm 12 can be brought out of the flat position into the position essentially resting against the inner surface of the pressure vessel 10. Between the pressure vessel 10 and the columns 11 there is also a releasable intermediate ring 17, the inside diameter of which corresponds approximately to that of the diaphragm 12 when the latter is raised as a result of suction. This inside diameter also corresponds to that of the receiving vessel 4. Furthermore, the height of the receiving vessel 4 matches the distance between the plate 2 and the pressure vessel 10, including the intermediate ring 17, so that the receiving vessel 4 can be moved with only slight play under the pressure vessel 10 into the pressing station.

There is, coaxial relative to the pressure vessel 10, in the plate 2 of the base frame 1 an orifice into which a counterplate 18 can penetrate, so that, in a position of rest, it forms with the plate 2 a smooth surface. The diameter of the counterplate 18 matches that of the intermediate ring 17, so that the counterplate 18 can penetrate into the intermediate ring 17 with a slight play. For this purpose, there is a lifting device 19 consisting, for example, of a pair of scissor levers 20, one end of which is articulated in a lug 21 in the bottom of the base frame 1 and a lug 22 on the underside of a lifting plate 27, on which the counterplate 18 rests loosely. The other end of the pair of scissor levers is equipped with rollers 23 which run along on the bottom of the base frame 1 and on the underside of the lifting plate 27. An adjusting cylinder 25 mounted on the rear wall of the base frame 1 engages at the point of articulation 24 of the pair of scissor levers 20. It is evident that, when the piston of the adjusting cylinder 25 is extended, the counterplate 18 can be raised upwards into the closing position indicated by dot-and-dash lines, in which it is located within the intermediate ring 17 and closes the orifice of the pressure vessel 10. For this purpose, it has on the periphery an annular grove 26, into which locking pins 28 or similar locking means guided radially in the intermediate ring 17 engage in the closing position, in order to connect the counterplate 18 positively to the pressure vessel 10. The locking pins 28 are moved into and out of the locking position by adjusting means known per se.

The receiving vessel 4 also has a stop 29 on its front side facing the pressure vessel 10. A conveyor belt 30 is provided at the end of the base frame 1 located opposite the receiving vessel 4. On the side facing the receiving vessel 4, the pressure vessel 10 has articulated on it a lid 31 which is moved by means of an adjusting cylinder 32 out of the inclined filling position into the closing position indicated by dot-and-dash lines. In the closing position, the lid 31 rests on the receiving vessel 4 and closes its filling orifice.

It is evident that, when the lid 31 is opened, a batch of articles can be dumped into the receiving vessel 4 by means of a chute 33 which is tilted downwards from the raised position into the filling position indicated by dot-and-dash lines. After the chute 33 has been swung up, the lid 31 is swung down, so that possibly projecting parts of the batch of articles are pushed down into the receiving vessel 4. Subsequently, the drawing means 6 is set in motion in a clockwise direction, so that the receiving vessel 4 is moved on the plate 2 into the pressing station above the counterplate 18. In the end position, the counterplate 18 is raised and brought into the closing position, in which it is locked by means of the locking pins 28, while the batch of articles is conveyed in an enclosed duct from the receiving vessel 4 into the pressure vessel. The lifting plate 27 is then lowered again and the receiving vessel 4 is moved back into the filling station. After the lid 31 has been swung up, it is already possible to introduce the next batch of articles.

After the counterplate 18 has been locked, a pressure medium is introduced into the pressure vessel 10 and the diaphragm 12 is consequently pushed downwards against the batch of articles. The liquid pressed out thereby flows down through bores 34 in the counterplate 18 into the basic frame 1 designed as a collecting vessel and through a bore 35 to the outside. After the pressing time has elapsed, the pressure medium is pumped out of the pressure vessel 10. At the same time, the lifting plate 27 moves upwards and comes up against the counterplate 18 which is now released. When the counterplate 18 is lowered into its initial position, the batch of articles pressed dry is also brought into the transport plane of the receiving vessel 4. Thus, at the start of the next cycle, the batch of articles pressed dry is pushed by the stop 29 onto the conveyor belt 30 and on the latter is fed to the next treatment machine, such as, for example, a drier, mangle or the like.

Figure 2:
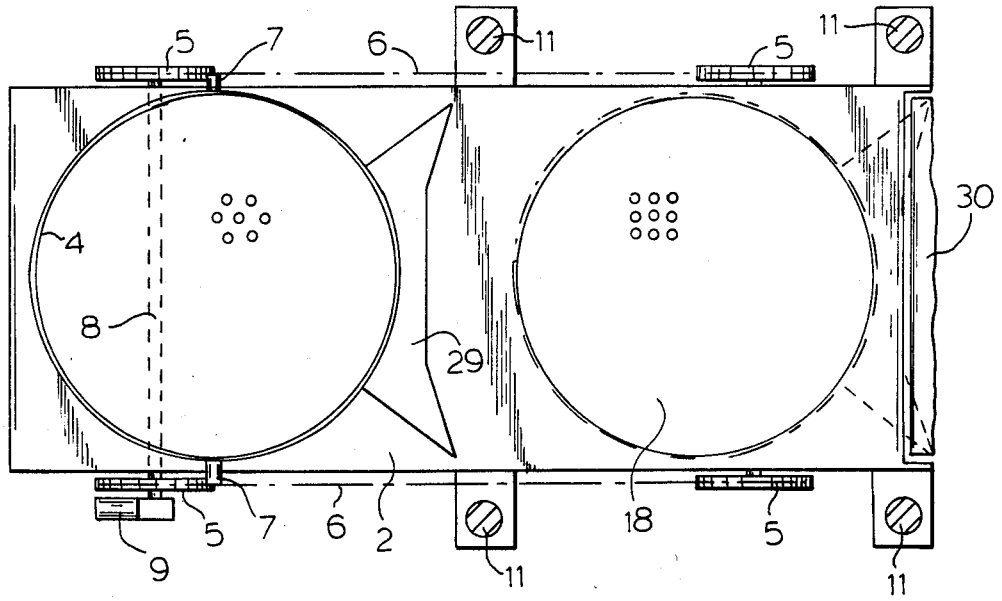
FIG. 2 shows a sectional view along the line II—II in FIG. 1.

The exemplary embodiment of FIGS. 3 and 4 resembles that of FIGS. 1 and 2. The same parts have therefore been provided with the same reference numerals. The counterplate 18 rests on a press cylinder 36 which is preferably of telescopic design. The counterplate 18 serves as a press plate and penetrates into the approximately cylindrical pressure vessel 10, in order to press dry the batch of articles. The water pressed out flows through bores 37 in the pressure vessel 10 into a ring 38 attached on the outside and is discharged from this in a way not shown.

So that the receiving vessel 4 can be moved back into the filling station even after the counterplate 18 has been raised, that is to say the press cylinder 36 has been extended, there is on the front side a door 39, the door leaves of which are moved by means of adjusting cylinders 40 out of the closing position into the open position represented by dot-and-dash lines, in which the press cylinder 36 can pass through. In the filling station, the door 39 is closed and the next batch of articles can be introduced into the receiving vessel 4. Otherwise, the pressing operation takes place in the way described, the pressing force can be exerted by the pressure medium introduced into the press cylinder 40.

A diaphragm 12 can, of course, also be provided in the pressure vessel 10 in the exemplary embodiment of FIGS. 3 and 4. Likewise, a diaphragm can also be arranged on the counterplate 18, if appropriate in addition to the diaphragm in the pressure vessel 10. In a further design, the receiving vessel 4 can also be arranged on a rotary mechanism.

I claim:

1. A continuous method for pressing batches of articles dry, particularly batches of laundry, in a press, comprising the steps of:

(a) filling a receiving vessel having an open top and bottom with the batch of articles at a filling station with a plate disposed below the vessel;

(b) moving the receiving vessel along the plate to a pressing station where the plate is provided with an orifice in which is disposed a counterplate;

(c) raising the counterplate with a lifting device through the open bottom and top of the receiving vessel into a pressure vessel disposed thereabove;

(d) locking the counterplate into a pressing position, closing the pressure vessel;

(e) lowering the lifting device;

(f) withdrawing the receiving vessel from the pressing station to the filling station to receive the next batch of articles; and (g) pressing the articles on the counterplate.

2. A press for pressing batches of articles dry, particularly batches of laundry, having a pressing station and a filling station, wherein said stations operate simultaneously thereby increasing pressing speed, said press comprising:

(a) a stationary pressure vessel at the pressing station adapted to receive a batch of articles therein to be dried through an orifice at the bottom thereof;

(b) a receiving vessel having an open top and bottom for receiving the batch of articles at the filling station and for transporting the batch to a position beneath said pressure vessel at the pressing station;

(c) a plate extending from said filling station to said pressing station arranged beneath said receiving vessel, at said pressing station said plate having an orifice therein; said receiving vessel having a height corresponding to the distance between said pressure vessel and said plate;

(d) a counterplate at said pressing station disposed at the orifice in said plate;

(e) means for locking said counterplate in a pressing position closing said pressure vessel;

(f) means for moving said receiving vessel from the filling station to the pressing station and back to the filling station; and (g) means for raising and lowering said counterplate, so that said counterplate, carrying a batch of articles to be pressed, may be raised from the plane of said plate through said receiving vessel and into said pressure vessel, through the orifice therein when said receiving vessel is in the pressing station, said means for raising and lowering being lowered back to the plane of said plate after said counterplate is locked into the pressing position, thereby allowing said receiving vessel to be moved back to the filling station to receive the next batch of articles, said counterplate carrying a pressed batch of articles, lowered back to the plane of said plate when said receiving vessel is in the filling station.

3. A press as claimed in claim 2, further comprising a diaphragm which can be subjected to a pressure medium disposed in said pressure vessel.

4. A press as claimed in claim 2, wherein the counterplate is a press plunger which penetrates into said pressure vessel and presses dry the batch of articles.

5. A press as claimed in claim 2, wherein at said filling station there is disposed a lid which covers said receiving vessel and which, in its closed position, lies approximately in a plane identical to the plane of the orifice of said pressure vessel.

6. A press as claimed in claim 2, wherein said receiving vessel is connected to a means of transport and is equipped on its side facing said pressure vessel with a stop for moving the batch of articles pressed dry.

7. A press as claimed in claim 2, wherein the means for allowing removal of said receiving vessel includes means for allowing said raising means to pass through the vessel during the movement of the vessel into the filling station.

* * * * *